US006578241B1

(12) United States Patent
Tan

(10) Patent No.: US 6,578,241 B1
(45) Date of Patent: Jun. 17, 2003

(54) BELT BUCKLE

(76) Inventor: Hong Tok Tan, Moktong Apartment 1421-601, 330, Sinjung 6-dong, Yangchun-ku, Seoul 158-076 (KR)

( * ) Notice: Subject to any disclaimer, the term of this patent is extended or adjusted under 35 U.S.C. 154(b) by 0 days.

(21) Appl. No.: 10/009,350

(22) PCT Filed: May 15, 2000

(86) PCT No.: PCT/KR00/00463

§ 371 (c)(1),
(2), (4) Date: Mar. 13, 2002

(87) PCT Pub. No.: WO00/69299

PCT Pub. Date: Nov. 23, 2000

(30) Foreign Application Priority Data

May 14, 1999 (KR) ..... 99-17463
May 6, 2000 (KR) ..... 2000-24252

(51) Int. Cl.[7] ..... A44B 11/02; A44B 11/06; A44B 11/12

(52) U.S. Cl. ..... 24/170; 24/191

(58) Field of Search ..... 24/170, 191, 636, 24/193

(56) References Cited

U.S. PATENT DOCUMENTS

| | | | | | |
|---|---|---|---|---|---|
| 500,705 | A | * | 7/1893 | Derrick et al. | 24/170 |
| 847,118 | A | * | 3/1907 | Sanders | 24/170 |
| 906,391 | A | * | 12/1908 | Dickson et al. | 24/170 |
| 1,313,210 | A | * | 8/1919 | Ross | 24/170 |
| 3,641,633 | A | * | 2/1972 | Leavenworth | 24/191 |
| 5,615,459 | A | * | 4/1997 | Wu | 24/309 |
| 5,735,023 | A | * | 4/1998 | Smith | 24/170 |

* cited by examiner

*Primary Examiner*—Robert J. Sandy
(74) *Attorney, Agent, or Firm*—Ostrolenk, Faber, Gerb & Soffen, LLP

(57) ABSTRACT

An inward-wind type belt buckle in which the rear end portion of a belt is wound between the front end portion of the belt and the clothes is disclosed. With the belt buckle, since the upper marginal portion of the side wall of the lower channel is not exposed forwardly, various types of patterns or designs can be expressed on the front plate of the belt buckle, thereby providing more elegant and refined belt buckle. In addition, since the hinge pin of the fixture for fixing the belt is not exposed outwardly, its stability in use is more improved.

6 Claims, 3 Drawing Sheets

BELT BUCKLE

TECHNICAL FIELD

The present invention relates to a belt buckle, and more particularly, to an improved combining structure for an inward-wind type belt buckle of which an upper and a lower channels make a passage for a belt and a rear end portion of the belt is wound between the front end portion of the belt and the clothes.

BACKGROUND ART

Belt buckles have a main function of steadily fixing clothes, especially trousers, to its user to thereby remove any uncomfortable factors in users' activities, as well as an additional function of satisfying aesthetic taste of the users.

Belt buckles in a variety of forms having such functions are in use.

With respect to the conventional belt buckles, the rear end portion of a belt is mostly wound outwardly of the front end portion of the belt that is fixed at the belt buckle, so that the rear end portion, that is, the end portion of the belt is kept separated from the clothes, which is not good in its appearance and apt to be touched by cuffs of jackets or taken by any objects when users are walking.

In order to solve the problems, Korean Patent Laid Open No. 1996-000111 (Publication date: Jan. 25, 1996), a prior application of the applicant of this invention, proposes an inward-wind type belt buckle that a rear end portion of a belt is wound between a front end portion and the clothes.

The inward-wind type belt buckle is made by an upper and a lower channel in a hexahedral shape forming a passage through which the rear end portion of the belt passes. The marginal portions at both sides of a plate body are bent to form the side walls having a predetermined height, and the lower end portions of each wall is attached to a lower channel in a plate form by welding to form a belt passage therebetween. A cut-out portion is formed at one side of the bottom of the lower channel through which a rear end portion of the belt passes.

Accordingly, when the user wears the belt, since the rear end portion of the belt is inserted into the internal passage of the buckle in the plate form and positioned between the front end portion of the belt and the clothes through after passing through the cut-out portion, it is not exposed.

In addition, a serrated hooking groove is formed at regular intervals at the inner face of the lower channel and a hook is protrusively formed upwardly at the entrance of the lower channel of the buckle so as to be hooked by a hooking hole of the belt, so that when the rear end portion of the belt is inserted into the internal passage of the belt buckle, the hook of the buckle is inserted into the hooking hole of the belt readily and fixedly.

That is, as shown in FIGS. 1 and 2, a hinge pin 31 is inserted at both sides of a fixture 30 is inserted into the hinge hole 22 formed at the side walls 21 of the upper channel 20 of the belt buckle so as for the fixture 30 to be rotatable, and the serrated portion 32 provided to the fixture 30 is in gear with the front end portion of the belt and attaches it to the bottom of the upper channel 20 of the belt buckle, thereby fixing the belt.

However, this kind of belt buckle has the following problems. That is, since the hinge pin 31 of the fixture 30 is exposed outwardly through the hinge hole 21 of the belt buckle, resulting in that the hinge pin 31 of the fixture 30 exposed outwardly may contact the skin of the user to hurt or clothes may be caught on the hinge pin to be torn off.

Meanwhile, FIG. 3 shows another type of belt buckle in accordance with a conventional art.

With reference to FIG. 3, side walls 51 and 41 are formed at an upper and lower channel 50 and 40 and combined by a rivet to form a belt buckle.

This type of belt buckle is constructed in that, for the sake of manufacturing method, the side wall 51 of an upper body 50 is inserted into the inner side of the side wall 41 of the lower channel 40 to thereby combine the upper and lower bodies 50 and 40. Thus, when it is viewed form the front side of the belt buckle, the upper side marginal portion of the side wall 41 of the lower channel 40 is exposed on the front face of the belt buckle, marring its appearance.

TECHNICAL GIST OF THE PRESENT INVENTION

Therefore, an object of the present invention is to provide a belt buckle of which a hinge pin of a fixture for fixing a front end portion to a belt buckle is not exposed outwardly, thereby improving a stability in wearing it.

Another object of the present invention is to provide a belt buckle of which a coupling portion of an upper channel and a lower channel is not exposed forwardly of the belt buckle, thereby having a fine appearance.

DETAILED DESCRIPTION OF THE INVENTION

In order to achieve the above objects, there is provided a belt buckle including: a lower channel having a cut-out portion at the central portion of the bottom plate and side walls formed bent to have a predetermined height in the lengthy direction at both sides thereof; an upper channel having side walls insertedly coupled with the inner side of the side walls of the lower channel; and a fixture having a serrated portion at one end portion thereof and hinge pins formed at the both end portions of the serrated portion so as to be inserted to the side walls of the upper channel and of the lower channel.

As for the belt buckle of the present invention, a wing part is extendedly formed at the outer marginal portion of the front plate of the upper channel, that is, at the outer portion of the both side walls, to cover the front end portions of each side walls of the lower channel so that they are not exposed when the upper and lower channel are combined.

Also, a groove is formed at both lower end portions of the rear sides of the side walls of the upper channel, to which the hinge pin of the fixture for fixing the front end portion of the belt is insertedly fixed.

In order to achieve the above objects, there is also provided a belt buckle in which an upper covering plate which has an area corresponding to the overall area including the both side walls of the lower channel is combined to the upper surface of the upper channel of the belt buckle, so that the side walls of the lower body is not exposed forwardly.

As for the belt buckle of the present invention, the upper covering plate has a plurality of fixing protrusions at a predetermined portion of the bottom, which are inserted into fixing holes formed at the front plate of the upper channel. By compressing the end portion of the fixing protrusions, attachment can be made.

MODE FOR CARRYING OUT THE PREFERRED EMBODIMENTS

Figure 1:
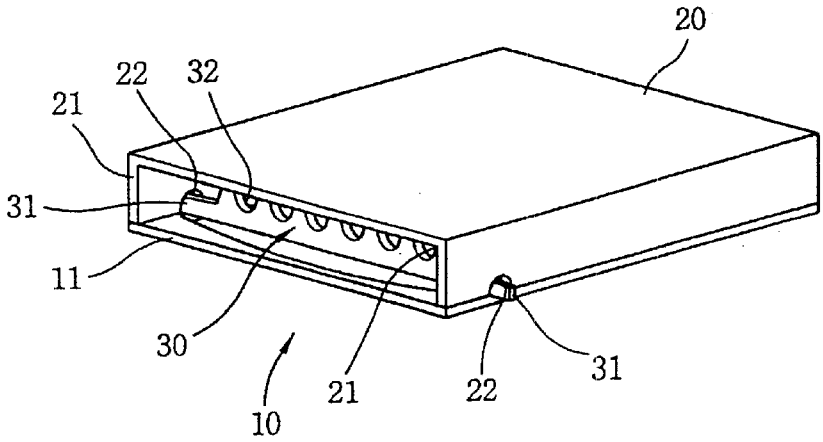
FIG. 1 is a perspective view of a belt buckle in accordance with one example of a conventional art.
Figure 2:
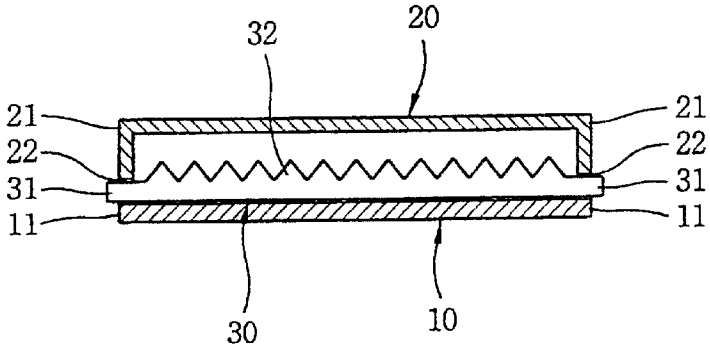
FIG. 2 is a sectional view showing a coupling structure of a fixture of FIG. 1 in accordance with the conventional art.
Figure 3:
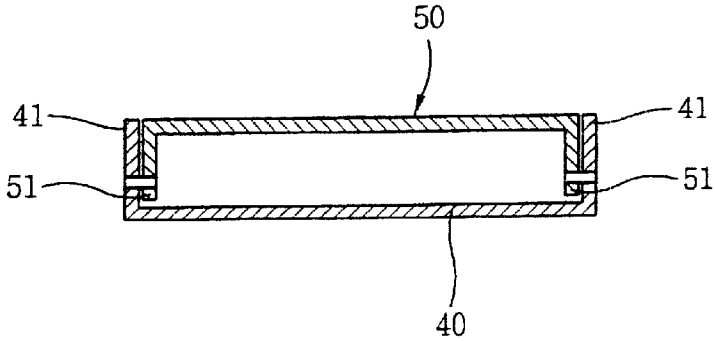
FIG. 3 is a sectional view of a belt buckle in accordance with another example of a conventional art.
Figure 4:
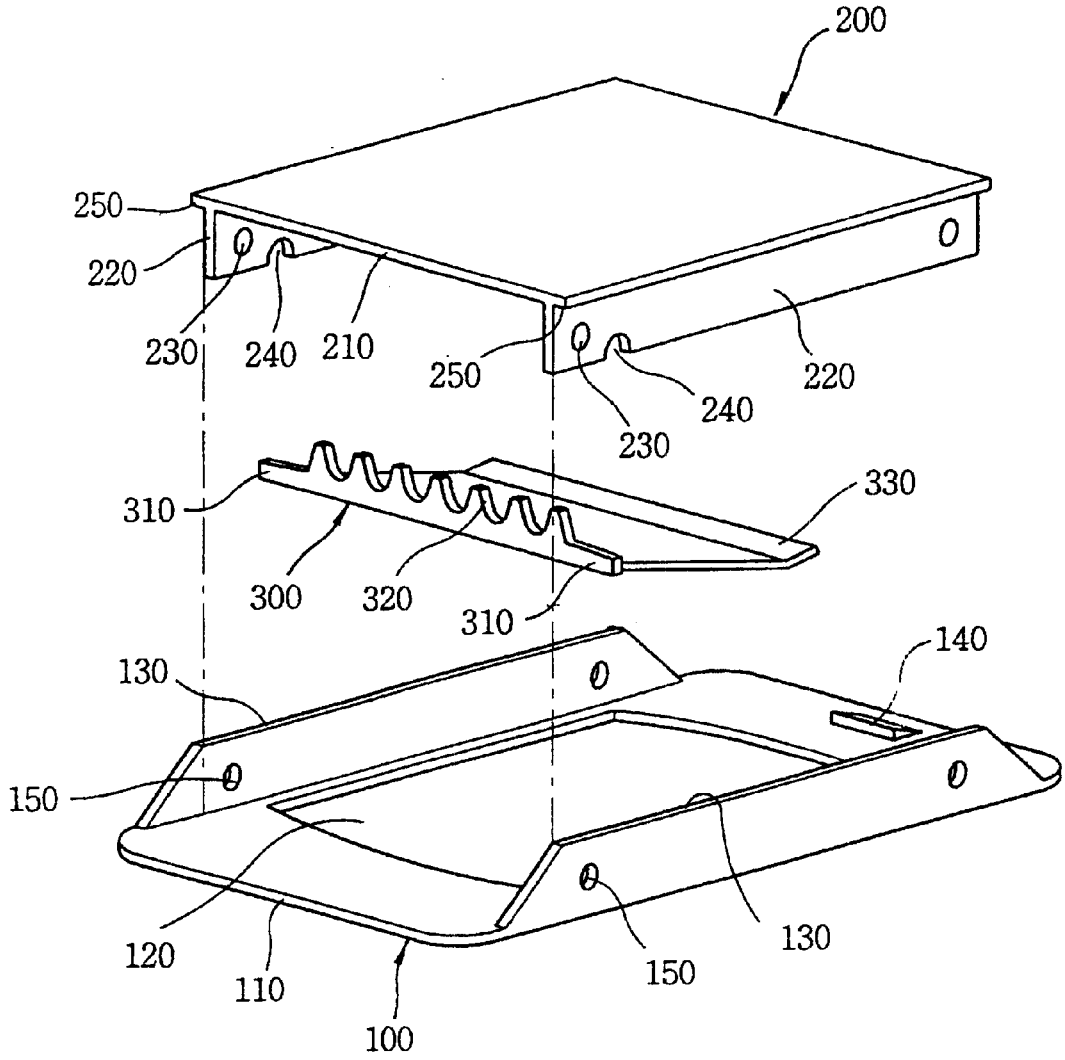
FIG. 4 is a disassembled perspective view showing a structure of a belt buckle in accordance with one embodiment of the present invention.
Figure 5:
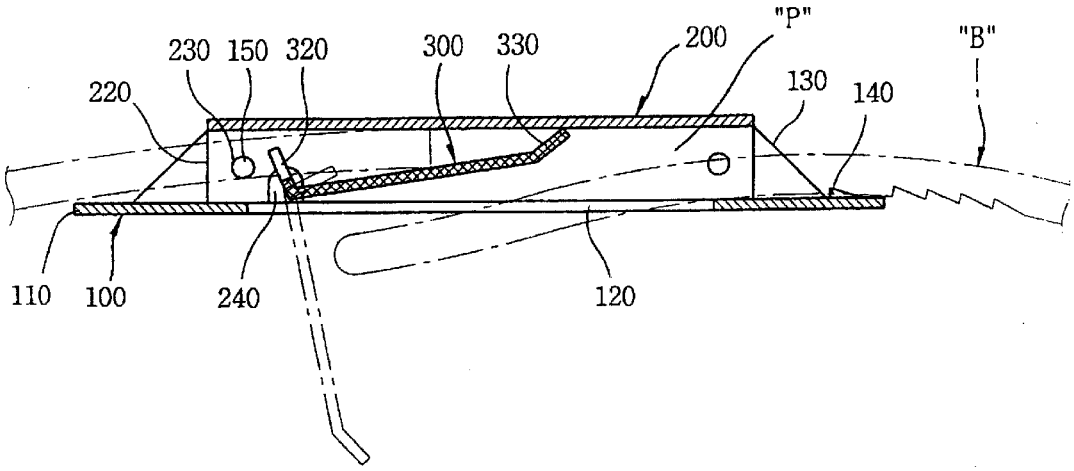
FIG. 5 is a sectional view showing an operation of the belt buckle after it is completely assembled in accordance with one embodiment of the present invention.

FIG. 4 is a disassembled perspective view showing a structure of a belt buckle in accordance with one embodiment of the present invention.

With reference to FIG. 4, reference numerals 100 and 200 denote a lower channel and an upper channel, respectively. The lower channel 100 includes a rectangular bottom plate 110 having a rectangular cut-out portion 120 at its central portion and side walls 130 formed bent to be almost at a right angle with the outer marginal portion of the bottom plate 110 in the lengthy direction.

And, at one side of the upper surface of the bottom plate 110, a hook 140 is protrusively formed to be upwardly sloped from the entrance side to the inside thereof. Fixing holes are formed at both sides of the front and rear portions of the side walls 130, respectively.

The upper channel 200 to be combined to the lower channel 100 includes a front plate 210 making a front portion of the belt buckle, and side walls 220 being at about a right angle with the bottom of the front plate 210 in the lengthy direction.

The side walls 220 are disposed at a certain interval so as to be tightly inserted into the inner side of the side walls 130 of the lower channel 100. Fixing holes 230 are formed at the both sides of the front and rear portion of the side walls 220, respectively, corresponding to the fixing holes 150 formed at the side walls 130 of the lower channel 100.

A semi-circular fixing grooves 240 is formed at one side of the side wall 220, to which the hinge pin 310 of the fixture 300 is inserted when the upper and lower channels 100 and 200 are combined each other.

Wing parts 250 are extendedly formed at the outer portion of the side wall 220 having the same thickness as that of the side wall 130 of the lower channel 100, so that when the upper and lower channel 200 and 100 are combined, the upper end marginal portion of the side wall 130 of the lower channel can be hidden.

The fixture 300 is constructed in that its end portion at which the hinge pin 310 is positioned is about perpendicularly bent and serrated portion 320 is formed at the end portion of the bent portion so that when the belt 'B' is fixed, the front end portion of the belt 'B' is firmly fixed at the bottom face of the front plate 210 of the upper channel 200. The other end portion thereof is bent to have a predetermined slope angle toward the front plate 210 of the upper channel 200, so that the rear end portion of the belt 'B' can be smoothly induced into the cut-out portion 120 formed at the bottom platen 110 after passing through the belt passage 'P'.

The hinge pin 310 of the fixture is rotatably combined to a space portion formed between the fixing groove 240 formed at the side wall 220 of the upper channel 200 and the upper surface of the bottom plate 110 of the lower channel, so that its end portion is not exposed outwardly.

The fixture 300, as shown in FIG. 4, is rotated centering around the hinge pin 310 so that it can be exposed outwardly through the cut-out portion 120 formed at the bottom plate 110 of the lower channel 100.

In assembling the belt buckle according to one embodiment of the present invention constructed as described above, the side wall 220 is correspondingly inserted to inner side of the side wall 100. At this time, when the upper and lower channel 200 and 100 are combined in a state that the hinge pin 310 of the fixture 300 is positioned at the fixing groove 240 formed at the side wall 200 of the upper channel, the hinge pin 310 is closed within in the space formed between the fixing groove 240 and the bottom plate 110 of the lower channel 100, thereby combining the fixture while preventing from arbitrarily releasing, and the end portion of the hinge pin 310 is hidden by the side wall 130 of the lower channel 100, without being exposed outwardly.

In this state, the upper and lower channels 200 and 100 are fixed through the fixing holes 230 and 150 formed at the side walls 220 and 130 thereof by using a rivet, thereby completing their combination. In this manner of combination, since the wing part 250 formed at the front plate 210 of the upper channel 200 completely covers the side wall 130, the upper end portion of the side wall 130 won't be exposed on the front surface. Accordingly, by designing a pattern or a marking on the front plate 210, it is possible to provide various expressive outer appearances of the belt buckle.

In the state that the upper and lower channels 200 and 100 are combined, as shown in FIG. 4, the fixture 300 is downwardly rotated through the cut-out portion 120 formed at the bottom plate 110 of the lower channel 100, and then the front end portion of the belt 'B' is positioned between the serrated portion 320 of the fixture 300 and the lower surface of the front plate 210 of the upper channel 200. In this state, when the fixture 300 is pushed toward the front plate 210, the front end portion of the belt 'B' is firmly fixed onto the lower surface of the front plate 210 of the upper channel 200 by virtue of the serrated portion 320 formed at the fixing end portion of the fixture 300.

And, in this state, when the rear end portion of the belt 'B' is inserted through the passage 'P' formed between the upper and the lower channels 200 and 100, the rear end portion of the belt 'B' is guided by the sloped end portion 330 of the fixture 300 and wound between the front end portion of the belt 'B' and the clothes through the cut-out portion 120 formed at the bottom plate 110 of the lower channel 100, without being exposed outwardly.

Figure 6:
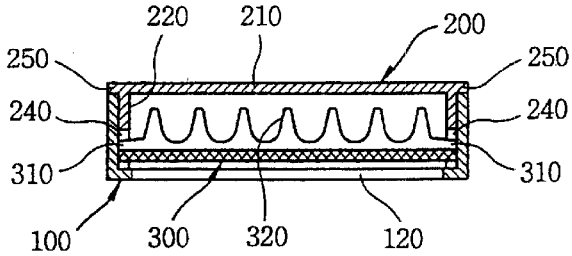
FIG. 6 is a sectional view showing a coupling structure of a fixture of the belt buckle in accordance with one embodiment of the present invention.
Figure 7:
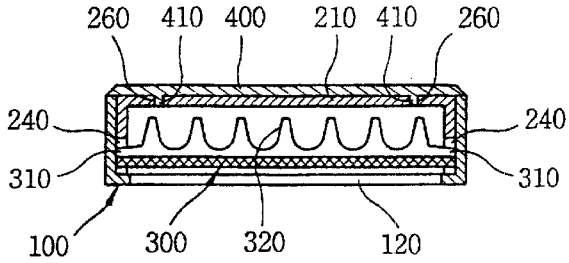
FIG. 7 is a sectional view showing a coupling state of a belt buckle in accordance with another embodiment of the present invention.

FIG. 7 is a sectional view showing a coupling state of a belt buckle in accordance with another embodiment of the present invention, in which, rather than forming a wing part 250 at the upper channel 200 as in the first embodiment shown in FIG. 6, a separate cover plate 400 corresponding to the whole area of the lower channel 100 is combined to the upper channel 200.

That is, a plurality of fixing holes 260 are formed at predetermined portions of the front plate 210 of the upper channel fixing protrusions 410 are formed at the portions corresponding to the fixing holes 260 are formed at the lower surface of the cover plate 400 having the area corresponding to the whole area of the lower channel 100, of which the fixing protrusion 410 is inserted into the fixing hole 260 and then pressed, thereby attaching the cover plate 400 to the front plate 210 of the upper channel 200.

According to this embodiment of the present invention, the front surface of the cover plate 400 can be expressively formed in various types of design by drawing a figure or marking. Also, since the cover plate 400 can be separatedly fabricated, the surface can be engraved in various design, thereby avoiding monotonous form and providing a high quality belt buckle.

INDUSTRIAL APPLICABILITY

As so far described, according to the inward-wind type belt buckle in the manner of which the upper and lower channel are combined in the present invention, since the upper marginal portion of the side wall of the lower channel is not exposed forwardly, various types of patterns or designs can be expressed on the front plate of the belt buckle, thereby providing more elegant and refined belt buckle.

In addition, since the hinge pin of the fixture for fixing the belt is not exposed outwardly, its stability in use is more improved.

What is claimed is:

1. A belt buckle comprising:

a lower channel having a bottom plate with a cut-out portion at the central portion thereof and side walls formed at both marginal portions of the bottom plate;

an upper channel having a front plate and side walls formed at the lower surface of the front plate to be combined with the side walls of the lower channel, a fixing groove being formed at a lower portion of the upper channel side walls; and a fixture having a serrated portion at one end portion thereof and hinge pins inserted into a closed space formed by the fixing groove formed at the side walls of the upper channel and the upper surface of the bottom plate of the lower channel.

2. The belt buckle according to claim 1, wherein the front plate includes a wing part extendedly formed at a outer portion of the side walls, the wing part is as thick as the thickness of the side walls of the lower channel.

3. The belt buckle according to claim 1, wherein a hook for fixing the position of the belt is protrusively formed at a predetermined portion of the bottom plate of the lower channel body.

4. The belt buckle according to claim 1, wherein a guide end portion is formed bent with a slope angle at one end portion of the fixture.

5. The belt buckle according to claim 1, wherein a cover plate is attached at the upper surface of the front plate of the upper channel, with a size to completely cover the lower channel.

6. The belt buckle according to claim 5, wherein a fixing protrusion is formed at the bottom surface of the cover plate, and a fixing hole is formed at the front plate into which the fixing protrusion is insertedly fixed.

* * * * *